United States Patent [19]

Billenstein et al.

[11] Patent Number: 4,668,439

[45] Date of Patent: May 26, 1987

[54] PROCESS FOR THE PREPARATION OF FATTY ACID ESTERS OF SHORT-CHAIN ALCOHOLS

[75] Inventors: Siegfried Billenstein; Bruno Kukla; Herbert Stuhler, all of Burgkirchen, Fed. Rep. of Germany

[73] Assignee: Hoechst Aktiengesellschaft, Fed. Rep. of Germany

[21] Appl. No.: 741,639

[22] Filed: Jun. 5, 1985

[30] Foreign Application Priority Data

Jun. 7, 1984 [DE] Fed. Rep. of Germany ..... 3421217

[51] Int. Cl.[4] ..... C11C 3/02

[52] U.S. Cl. ..... 260/410.9 R

[58] Field of Search ..... 260/410.9 E, 410.9 R; 560/231

[56] References Cited

U.S. PATENT DOCUMENTS

| | | | |
|---|---|---|---|
| 2,177,407 | 10/1939 | Hansley | 260/410.9 E |
| 2,378,007 | 6/1945 | Eckey | 260/410.9 E |
| 2,383,614 | 8/1945 | Percy | 260/410.9 E |
| 2,383,632 | 8/1945 | Trent | 260/410.9 E |
| 2,447,186 | 8/1948 | King et al. | 260/410.9 E |
| 2,494,366 | 1/1950 | Sprules et al. | 260/410.9 E |

OTHER PUBLICATIONS

Wasilewicy-Niedbalska et al, Chem. Abst., vol. 99, #24421h, (1983).

Nieto, Chem. Abst., vol. 84, #137571, (1976).

Kreutzer, *JAOCS,* 61:343-348, (1984).

Poré et al, *OLEAGINEAUX* 7, (No. 11):641-644, (1952).

*Primary Examiner*—James H. Reamer

*Attorney, Agent, or Firm*—Connolly and Hutz

[57] ABSTRACT

A process for the preparation of fatty acid esters of short-chain primary and secondary alcohols with 1 to 5 carbon atoms by transesterification of glycerides with the said short-chain alcohols is described. In this process, a stream of the gaseous alcohol is passed through the liquid glyceride at temperatures of at least 210° C. and the product mixture of gylcerol and fatty acid alkyl ester is discharged from the reaction zone with this stream and is then subjected to phase separation.

9 Claims, No Drawings

PROCESS FOR THE PREPARATION OF FATTY ACID ESTERS OF SHORT-CHAIN ALCOHOLS

The invention relates to a process for the preparation of fatty acid esters by transesterification of glycerides with short-chain alcohols.

Fatty acid esters of short-chain alcohols are of considerable industrial importance as intermediates, for example for the preparation of fatty alcohols or fatty nitriles or in the preparation of soaps. They can also be used directly as components of certain engine fuels, in particular diesel fuels.

Preparation processes for fatty acid esters of short-chain alcohols starting from fats and oils of natural origin have been known for a long time. The fundamental process is described in U.S. Pat. Nos. 2,271,619 and 2,360,844 from 1939: the fat or oil is mixed with the short-chain aliphatic alcohol and an alkaline catalyst and the mixture is heated to about 80° C. After a short period of time, the reaction mixture starts to separate into two layers, and the glycerol settles on the bottom of the vessel and can be removed from there. Excess alcohol is removed by distillation and the fatty acid ester formed is then distilled or, if appropriate, split up into fractions. This process has since been improved in many ways. A review of the current state is given in the paper in JAOCS, 61 (1984), page 343 et seq., in particular pages 344 to 346, also taking into consideration the continuous procedure which is usual today. The essential disadvantage of this transesterification process is also referred to there.

If the reaction is to proceed under mild reaction conditions (at 50° to 70° C. and approximately atmospheric pressure), it is absolutely necessary to remove the free fatty acids contained in the starting substance by preesterification or other measures. Only if the process is carried out under a high pressure at a high temperature, for example under 90 bar at 240° C., and with a high excess of methanol can this prior removal of free fatty acids be dispensed with, so that in this case fats and oils which have not been deacidified can also be used.

The reason for this difficulty is probably that the soaps which form from free fatty acids with the alkaline catalyst have an emulsifying effect on the glycerol and thus impede or render impossible its removal from the fatty acid ester formed. However, since the separating out of the glycerol as a separate phase removes this reactant from the equilibrium and thus promotes the advance of the reaction, this process of incomplete separation or emulsification is highly undesirable both because the advance of the reaction is impeded and because the glycerol thereby becomes contaminated.

A whole series of process modifications and process improvements with the aid of which these disadvantages are said to be eliminated have already been developed. Thus, U.S. Pat. No. 3,383,614 describes a process for the continuous alcoholysis of fats in which partial esterification of the fat or oil is first carried out—if appropriate in several steps—and the separating out of the glycerol is correspondingly also effected in several stages. According to U.S. Pat. No. 2,383,580, the catalyst should first be inhibited when the reaction has ended, by neutralizing the reaction mixture, the excess alcohol is then removed by distillation and, finally, the mixture which remains is distilled in vacuo, the condensate rapidly separating into a glycerol layer and a fatty acid alkyl ester layer. According to U.S. Pat. No. 2,383,633, the excess alcohol should first be distilled off and the separation of the mixture which remains into glycerol and fatty acid alkyl ester should then be facilitated by acidification with mineral acid. All of these processes are unsatisfactory, in particular from the point of view of a simple reaction procedure and the isolation of the glycerol in the maximum possible yield and purity.

Even very recently, a process has therefore been developed, according to U.S. Pat. No. 4,164,506, for the esterification of non-prerefined fats to the effect that, in a two-stage process, the free fatty acids are first converted into their esters with short-chain alcohols in the presence of acid catalysts and the conversion of the glycerides into the fatty alkyl esters is then carried out in the presence of alkali, glycerol being separated off.

According to a publication by J. Poré and J. Verstraete, Oléagineux 7 (1952) No. 11, pages 641 to 644, attempts have already been made to bypass this obstacle by using an acid catalyst and adding the methanol in vapor form. Glycerol is usually not separated out here. If the glycerol is separated out of the reaction vessel stepwise, the yield of ester should be increased somewhat, but the same difficulties then occur as in the process described above.

There is thus a need for a process which is not adversely influenced if, above all, non-pretreated fats and oils containing free fatty acids and/or mucins in relatively large amounts are used. A procedure under high pressure, which is very expensive from the point of view of plant costs, should be avoided, but nevertheless high-quality fatty acid alkyl esters and glycerol should be obtained without expensive pretreatment and aftertreatment.

This need is taken into account by a process for the preparation of fatty acid esters of short-chain primary and secondary alcohols with 1 to 5 carbon atoms by transesterification of glycerides with such short-chain alcohols in the presence of transesterification catalysts at elevated temperatures, which comprises bringing the liquid glyceride into intimate contact with a stream of gaseous alcohol at temperatures of at least 210° C., the throughput of this stream per unit time being at least such that it is capable of rapidly discharging the resulting product mixture of glycerol and fatty acid ester together out of the reaction zone, after which the product mixture is condensed and subjected to phase separation into a fatty acid ester phase and a glycerol phase and the excess gaseous alcohol is recycled to the reaction zone.

Starting substances for the process according to the invention are mono-, di- and tri-glycerides of the general formula $$\begin{array}{l} CH_2-O-X \\ | \\ CH-O-Y \\ | \\ CH_2-O-COR^3, \end{array}$$

in which X is $COR^1$ or H, Y is $COR^2$ or H and $R^1$, $R^2$ and $R^3$, which can be identical or different, denote aliphatic hydrocarbon groups with 3 to 23 carbon atoms, it being possible for these groups optionally to be substituted by an OH group, or any desired mixtures of such glycerides.

This means that in this formula, one or two fatty acid esters can be replaced by hydrogen and the fatty acid esters $R^1CO$—, $R^2$—CO— and $R^3CO$— are derived from fatty acids with 3 to 23 carbon atoms in the alkyl chain. $R^1$ and $R^2$, or $R^1$, $R^2$ and $R^3$ in the abovementioned formula can be identical or different if the compounds are di- or tri-glycerides. The radicals $R^1$, $R^2$ and $R^3$ belong to the following groups:

(a) alkyl radicals, which can be branched, but are preferably straight-chain, and have 3 to 23, preferably 7 to 23, carbon atoms;

(b) olefinically unsaturated aliphatic hydrocarbon radicals, which can be branched, but are preferably straight-chain, and have 3 to 23, preferably 11 to 21 and in particular 15 to 21, carbon atoms and contain 1 to 6, preferably 1 to 3, double bonds, which can be conjugated or isolated; and (c) monohydroxy-substituted radicals of type (a) and (b), preferably olefinically unsaturated olefin radicals which have 1 to 3 double bonds, and in particular the radical of ricinoleic acid.

The acyl radicals $R^1CO$—, $R^2CO$— and $R^3CO$— of those glycerides which are suitable as starting materials for the process of the present invention are derived from the following groups of aliphatic carboxylic acids (fatty acids):

(a) alkanoic acids or alkyl-branched, in particular methyl-branched, derivatives thereof, which have 4 to 24 carbon atoms, such as, for example, butyric acid, valeric acid, caproic acid, heptanoic acid, caprylic acid, pelargonic acid, capric acid, undecanoic acid, lauric acid, tridecanoic acid, myristic acid, pentadecanoic acid, palmitic acid, margaric acid, stearic acid, nonadecanoic acid, arachidic acid, behenic acid, lignoceric acid, 2-methylbutanoic acid, isobutyric acid, isovaleric acid, pivalic acid, isocaproic acid, 2-ethylcaproic acid, the positional isomers of methylcapric acid, methyllauric acid and methylstearic acid, 12-hexylstearic acid, isostearic acid or 3,3-dimethylstearic acid.

(b) Alkenoic acids, alkadienoic acids, alkatrienoic acids, alkatetraenoic acids, alkapentaenoic acids and alkahexaenoic acids and alkyl-branched, particularly methylbranched, derivatives thereof, with 4 to 24 carbon atoms, such as, for example, crotonic acid, isocrotonic acid, caproleic acid, 3-lauroleic acid, myristoleic acid, palmitoleic acid, oleic acid, elaidic acid, erucic acid, brassidic acid, 2,4-decadienoic acid, linoleic acid, 11,14-eicosadienoic acid, eleostearic acid, linolenic acid, pseudoeleostearic acid, arachidonic acid, 4,8,12,15,18,21-tetracosahexaenoic acid or trans-2-methyl2-butenoic acid.

($c_1$) Monohydroxyalkanoic acids with 4 to 24 carbon atoms, preferably with 12 to 24 carbon atoms, and preferably straight-chain, such as, for example, hydroxybutyric acid, hydroxyvaleric acid, hydroxycaproic acid, 2-hydroxydodecanoic acid, 2-hydroxytetradecanoic acid, 15-hydroxypentadecanoic acid, 16-hydroxyhexadecanoic acid and hydroxyoctadecanoic acid.

($c_2$) Furthermore, monohydroxyalkenoic acids with 4 to 24, preferably with 12 to 22 and in particular with 16 to 22 carbon atoms (preferably straight-chain) and with 1 to 6, preferably with 1 to 3 and in particular with one, ethylenic double bond, such as, for example, ricinoleic acid or ricinelaidic acid.

Preferred starting substances for the process according to the invention are, above all, the naturally occurring fats, which are mixtures of predominantly triglycerides and small amounts of diglycerides and/or monoglycerides, these glycerides also usually in turn being mixtures and containing various fatty acid radicals in the abovementioned range, in particular those with 8 or more carbon atoms. Examples which may be mentioned are vegetable fats, such as olive oil, coconut oil, palmkernel oil, babussu oil, palm oil, peanut oil, rape oil, castor oil, sesame oil, cotton oil, sunflower oil, soybean oil, hemp oil, poppy-seed oil, avocado oil, cottonseed oil, wheatgerm oil, maize germ oil, pumpkin seed oil, grapeseed oil, cacao butter and also vegetable tallows, and furthermore animal fats, such as beef tallow, lard, bone fat, mutton tallow, Japan wax, spermoil and other fish oils as well as cod-liver oil. However, it is also possible to use triglycerides, diglycerides and monoglycerides which are single compounds, whether these have been isolated from naturally occurring fats or obtained by a synthetic route. Examples which may be mentioned here are: tributyrin, tricapronin, tricaprylin, tricaprinin, trilaurin, trimyristin, tripalmitin, tristearin, triolein, trielaidin, trilinoliin, trilinolenin, monopalmitin, monostearin, monoolein, monocaprinin, monolaurin and monomyristin, or mixed glycerides, such as, for example, palmitodistearin, distearoolein, dipalmitoolein or myristopalmitostearin.

It is of essential importance for the process according to the invention to remove the glycerol rapidly from the reaction zone when it is liberated by the transesterification reaction. This is achieved by discharging the glycerol in a stream of gaseous alkanol together with the fatty acid ester formed. This stream should be rated so to render possible the discharge into the condensation vessel. For this, a certain minimum throughput of vaporous, short-chain alcohol, based on the amount of glyceride multiplied by the time in which the alcohol is passed through, is required. This throughput is given here in moles of alcohol/kg of glyceride per hour. The amount of glyceride here in a batchwise procedure is understood as the starting amount of glyceride initially introduced. Accordingly, the scope of this invention is not exceeded if, in the subsequent course of the reaction, especially towards the end of the reaction, the throughput falls below this minimum throughput, if appropriate, corresponding to the reduced amount of glyceride or fat still present in the reaction vessel. In the case of a continuous procedure, the throughput of gaseous alcohol depends on the amount of glyceride initially introduced into the reaction space and/or maintained by a feed. The minimum throughput mentioned is 8 moles of alcohol/kg of glyceride per hour. In general, however, this throughput is chosen above this value, depending, in particular, on the nature of the glyceride, fat or oil employed, but also on the apparatus circumstances in the zone between the reaction vessel and condensation vessel, where premature condensation of the discharged product mixture should be prevented. The required throughput also furthermore depends on the chain length of the alcohol employed and, associated therewith, on the volatility of the ester formed and also on the reaction temperature within the temperature range according to the invention. The throughput per kilogram of glyceride per hour is preferably in the range from 20 to 40 moles of alcohol. The upper limit is not critical, but is in any case subject to economic considerations, if the amount of circulating gas is not to be unnecessarily large. Up to 30%, preferably up to 15%, of inert gas, such as, for example, nitrogen, can advantageously be added to this throughput of alcohol.

Possible short-chain alcohols for the esterification reaction are primary and secondary alcohols with 1 to 5 carbon atoms in a straight or branched chain, thus, for example, pentanol, butanol and isobutanol, but preferably ethanol, propanol and isopropanol, and in particular methanol.

The reaction temperature is chosen in the range from 210° to 280° C., preferably from 230° to 260° C. The choice depends, above all, on the volatility of the particular fatty acid alkyl ester formed and also on the throughput of the gaseous alcohol. The temperature can rise above the initial value or fall below the initial value within this range during the reaction, and if appropriate can also be modified continuously or according to a fixed temperature programme; however, the reaction temperature is preferably maintained until the end of the reaction.

The reaction is usually carried out under atmospheric pressure, but use of reduced or increased pressure also does not go outside the scope of this invention, especially if this results from the pressure conditions prevailing in the circulation.

For the preparation of fatty acid alkyl esters and glycerol from glycerides and short-chain alcohols, the presence of a customary transesterification catalyst is necessary, known catalysts which have also hitherto already been used in the alcoholysis of fats being employed. Examples of such transesterification catalysts which are suitable for the process according to the invention are alkali metal salts and other basic compounds of alkali metals with a salt character, such as, inter alia, alkali metal carbonates and bicarbonates, alkali metal stearates, laurates, oleates and palmitates (or mixtures of such soaps), alkali metal salts of other carboxylic acids, such as alkali metal acetates, alkali metal oxides, hydroxides, alcoholates and hydrides, and also alkali metal amides. The expression alkali metals here comprises all metals of the first main group, sodium and potassium being preferred for economic reasons.

Other groups of suitable transesterification catalysts are the heavy metal soaps, that is to say fatty acid salts, for example of manganese, zinc, cadmium and divalent lead; and furthermore heavy metal salts of alkylbenzenesulfonic acids, alkanesulfonic acids and olefinsulfonic acids, such as, in particular, the salts of zinc, titanium, lead, chromium, cobalt and cadmium. Finally, antimony trioxide has also proved to be suitable. The amount of transesterification catalyst required can vary within fairly wide limits in the process according to the invention, in particular depending on the contamination of the fat employed. It is in the range from 0.05 to 5% by weight, preferably from 0.2 to 3% by weight, based on the glyceride employed. In a fully continuous reaction procedure, this amount is based on the amount of glyceride initially introduced (which can in turn, if appropriate, be passed in a separate circulation), with the proviso that the amount subsequently fed in continuously corresponds to the discharge of the products formed during the transesterification, in each case per unit time.

The process according to the invention is carried out, for example, by the following procedure: the glyceride, that is to say usually a naturally occurring fat or oil, is initially introduced into a customary stirred vessel equipped with a temperature indicator, a heating device and a suitable device for passing in the vaporous stream of alcohol and, if appropriate, the inert gas into the liquid reaction mixture, the catalyst is added and the initially introduced fat is warmed to the reaction temperature. As soon as this is reached, the gaseous stream of alcohol is passed in via the inlet device, good thorough mixing of the gas and liquid being ensured. The stream of alcohol is passed from the reaction vessel together with the discharged product mixture into a condensation vessel or a system of condensation vessels, a shortest possible and well-isolated transfer being ensured, in order to avoid back-flow into the reaction vessel. The temperature in the condensation system here should be about 10° to 60° C., preferably 20° to 40° C., above the boiling point of the particular alcohol, with the proviso that the interval above the boiling point should be not greater than 40° C. in the case of alcohols with 4 or 5 carbon atoms. Whilst the alcohol thus passes through the condensation vessel in gaseous form and—if appropriate after washing—is recycled to the reaction zone, the product mixture of the fatty acid alkyl ester formed and glycerol is subjected to phase separation. If several condensation vessels are included, if appropriate, phase separation takes place after all the condensates have been combined. The condensation can be effected, for example, in one or several consecutive heat exchangers or by circulating the condensate over coolers and packed, tray or spray columns. Phase separation is carried out, for example, in settling vessels or in centrifuges. When the phase separation has been carried out, the glycerol is passed for working up. The excess alcohol is recycled back to the reaction vessel, after condensing. Particularly in the case of fats with relatively high contents of fatty acids, it may be advantageous for some of the alcohol to be transferred out of the circulation from time to time and be replaced by fresh alcohol, in order to reduce the water of reaction content.

The process according to the invention can also be carried out completely continuously, for example by a procedure in which methanol is passed from the bottom and heated liquid fat is passed from the top in countercurrent into a trickle-bed column or a reaction column, the volatile constituents are then discharged together at the top of the column and the methanol is circulated, as described above, and the products are subjected to phase separation and worked up. It is also possible for the alcohol and the glyceride to be passed with good thorough mixing from the bottom upwards in a bubble column. In respect of good thorough mixing of the glyceride and alcohol, the reaction procedure in a so-called loop reactor is particularly advantageous. In such a reaction procedure, the fat content and the catalyst contained therein are also circulated (separately), the reacted portion of starting glyceride being replaced in this circulation. In the case of a continuous procedure for the process according to the invention, the glyceride is initially introduced into the reactor. When the reaction has started, the glyceride is replaced at the rate at which it is consumed in the reaction, that is to say removed in the form of the reaction products.

The process according to the invention provides a number of considerable advantages over the processes which were hitherto usual:

(1.) The process can be carried out either with previously refined or with non-refined fats and oils. This means not only that the time-consuming and expensive removal of the fatty acids is eliminated—whether in a separate process or in the form of any prior reactions within the actual process operation—but also that so-called non-deslimed fats (for example unfiltered animal body fat) can be employed directly. Their use in processes which proceed with settling of the glycerol presents problems, since the mucins which are contained in the fat and act as naturally occurring emulsifiers also promote stable emulsions and thus impede the separating out of the glycerol.

(2.) The process according to the invention does not require the application of high pressure, such as is applied in the customary continuous settling processes. The process can be carried out under normal pressure, or at most slightly increased pressures (up to 5 bar) are necessary, resulting from the conditions in the reaction circulation.

(3.) The transfer of the ester formed in the methanol stream gives this ester in such a high purity that after-purification by distillation can be virtually dispensed with. Whilst a good yield of good quality crude glycerol is obtained in the known processes only from highly refined fats or after removal of the catalyst, this is possible also from fats of lesser quality in the process according to the invention.

The fatty acid esters, obtained according to the invention, of short-chain alcohols are used extensively. Besides the possible uses already mentioned above, the importance of these esters for the preparation of surfactant chemicals or precursors, such as alkanolamides, sugar-esters or α-sulfo-fatty acid esters, may also be mentioned. Glycerol is an important chemical compound which can be used, for example, for the preparation of disintegrating substances, as an additive to heat transfer and power transmission fluids, as a humectant additive to skin creams, toothpastes, soaps, tobacco and the like, as a textile auxiliary, as a solvent and in many other fields which are known to the expert.

The invention is illustrated by the following examples:

EXAMPLE 1

498 g of technical grade tallow (saponification number 195, acid number 1) together with 27 g of 30% strength by weight sodium methylate (in methanol) are initially introduced into a reaction vessel which can be heated, has a capacity of 800 $cm^3$ and is equipped with a stirrer, gas inlet tube, internal thermometer and a short transfer attachment to the receiver system which consists of two condensation vessels and in which the volatile reaction products are condensed. The tallow is warmed to 240° C. and is kept at this temperature. A stream of methanol gas of 12.6 moles/hour (corresponding to 25.3 moles/1,000 g of fat x hour) is produced continuously from liquid methanol in a vaporizer and is passed through the liquid tallow. The condensation system is kept at 90° C., so that the excess methanol gas leaving the reactor can then be recycled to the reactor. The reaction has ended after 3.75 hours. After this time, 498.5 g of crude condensate are obtained and are combined in a settling vessel, where separation takes place. The glycerol phase is then drained off. The fatty acid methyl ester phase is washed twice with 50 ml of water each time and, after drying, 441 g of tallow fat acid methyl ester with an acid number (AN) of 0.8 (95.8% of theory, corrected with the acid number) are obtained. The washing water is combined with the glycerol phase and the water is then removed in a rotary evaporator. 41.2 g of crude glycerol are obtained in this manner. The pure glycerol content of this crude glycerol is determined titrimetrically by the periodate method. It is 39.3 g of glycerol, that is to say 69.4% of theory.

Other experiments have been carried out with the apparatus described in Example 1 in a batchwise reaction procedure. The starting substances, the amount and quality of the end products obtained and the reaction parameters are summarized in the following Table I.

The following abbreviations and designations with the meanings shown below are used in Tables I and II:

Glycerides (SN=saponification number, AN=acid number)

A=technical grade tallow (SN 195; AN 1)

B=animal body fat, filtered (SN 187; AN 13; non-saponifiable contents, including mucins, 1.2% by weight)

C=animal body fat, unfiltered (SN 189; AN 8.6; non-saponifiable contents, including mucins, 1.6% by weight)

D=butter fat, crude (SN 188.5; AN 1.7; non-saponifiable contents, including mucins, 1.4% by weight; 12.3% by weight of water)

E=technical grade tallow (SN 188.5; AN 0.7)

F=coconut oil, crude (SN 244; AN 1.5)

G=soybean oil, crude (SN 187.9; AN 0.4)

H=rape oil, crude (SN 183.4; AN 9.4)

K=rapeseed oil, crude (SN 183.4; AN 11.8)

L=animal body fat, filtered (SN 191.3; AN 8.5; non-saponifiable contents, including mucins, 1.3% by weight)

M=castor oil, technical grade (SN 176.2; AN 1.6; OH number 164.4)

N=sunflower oil, edible grade (SN 178; AN 0.1)

O=olive oil, edible grade (SN 190; AN <0.1)

P=palm-kernel oil, crude (SN 229; AN 2.8)

R=glycerol tristearate, technical grade (SN 194; AN 4)

S=tallow, technical grade (SN 190.3; AN 1.3)

T=animal body fat, filtered (SN 182; AN 9.8)

Alcohols

I=methanol

II=ethanol

III=isopropanol

IV=n-propanol

V=n-butanol

Catalysts a=sodium methylate b=zinc laurate c=potassium methylate d=cesium laurate e=zinc dodecylbenzenesulfonate f=potassium hydroxide g=cesium carbonate h=sodium bicarbonate p=temperature program: 3 hours at 230° C., increased by 10° C./30 minutes to 260° C., continued at this temperature to the end of the reaction;

*=total throughput (whilst maintaining an amount of 500 g of glyceride in the reaction vessel);

**=throughput in moles/1,000 g of glyceride x hour;

(+)=reaction vessel of 400 $cm^3$ capacity; baffles, inlets and outlets as described;

(++)=in addition to the stream of methanol gas, 162 normal liters of nitrogen/1,000 g of glyceride per hour, that is to say 30% by volume, based on the normal volume, of the methanol, are also passed through.

TABLE 1

| Example | Glyceride Type | Glyceride Amount (g) | Alcohol Type | Alcohol Throughput** | Catalyst Type | Catalyst % by weight based on the glyceride | Temp. (°C.) | Reaction time (h) | Ester Amount (g) | Ester AN | product % of theory | Crude glycerol (g) | Glycerol by the periodic method (g) | % of glycerol of theory |
|---|---|---|---|---|---|---|---|---|---|---|---|---|---|---|
| 2+ | A | 200,5 | I | 37,5 | a | 0,45 | 230 | 4 | 182,8 | 0,1 | 90,7 | 18,5 | 18,4 | 84,7 |
| 3 | A | 503,0 | I | 22,3 | a | 1,6 | 220 | 7,25 | 448,1 | 0,4 | 96,6 | 41,6 | 39,1 | 71,9 |
| 4 | A | 502,5 | I | 28,4 | a | 1,6 | 270 | 2,25 | 447,0 | 1,2 | 96,4 | 36,5 | 34,1 | 63,2 |
| 5+ | A | 239,0 | I | 43,7 | b | 1,0 | 250 | 5 | 231,4 | 0,2 | 96,4 | — | 18,9 | 69,6 |
| 6+ | B | 200,8 | I | 50,1 | b | 2,0 | 250 | 3 | 183,0 | 0,4 | 91,7 | — | 13,9 | 66,3 |
| 7 | C | 503,0 | I | 28,8 | c | 2,0 | 240 | 3,25 | 441,7 | 0,8 | 95,7 | 37,9 | 33,8 | 75,0 |
| 8 | A | 501,0 | I | 24,1++ | d | 0,9 | 240 | 5,75 | 494,2 | 1,2 | 97,6 | 49,7 | 46,5 | 85,8 |
| 9 | A | 496,0 | I | 15,6 | a | 0,2 | P | 7 | 482,0 | 1,2 | 96,2 | 44,9 | 44,4 | 82,7 |
| 10 | D | 486,5 | I | 24,5 | a | 1,6 | 240 | 3 | 329,6 | 0,4 | 85,7 | 37,7 | 35,6 | 74,0 |
| 11 | A | 500,1 | II | 18,1 | a | 1,6 | 240 | 7 | 462,3 | 0,6 | 95,4 | 39,4 | 37,2 | 69,2 |
| 12 | E | 311,0 | III | 21,5 | a | 1,6 | 240 | 20 | 275,2 | 7,2 | 84,4 | 20,0 | 18,2 | 57,0 |
| 13+ | E | 152,0 | V | 37,4 | a | 1,6 | 240 | 3,75 | 133,7 | 0,2 | 83,3 | 11,7 | 10,4 | 66,8 |
| 14 | F | 418,2 | I | 28,5 | c | 1,1 | 240 | 3 | 391,4 | 3,5 | 95,4 | 44,0 | 42,7 | 83,4 |
| 15+ | G | 151,5 | I | 39,0 | a | 1,6 | 240 | 3 | 130,2 | 0,1 | 92,7 | 10,6 | 10,5 | 68,2 |
| 16 | H | 152,0+ | I | 41,2 | a | 1,6 | 240 | 3 | 139,5 | 0,4 | 98,8 | 11,0 | 10,7 | 74,0 |
| 17 | A | 494,0 | I | 48,0 | e | 0,5 | 240 | 5,75 | 474,3 | 1,6 | 95,6 | 28,4 | 27,0 | 50,5 |
| 18 | S | 495,6 | I | 24,9 | c | 0,1 | 240 | 5,5 | 463,4 | 0,3 | 93,0 | 41,8 | 41,5 | 81,0 |
| 19 | T | 488,8 | I | 19,8 | a | 3,2 | 230 | 7,75 | 381,8 | 0,2 | 94,0 | 24,9 | — | 55,1 |
| 20 | A | 500,0 | I | 10,0 | a | 1,6 | 240 | 9,25 | 434,9 | 0,5 | 94,0 | 41,7 | 40,4 | 74,7 |
| 21 | T | 425,2 | IV | 12,8 | a | 1,6 | 240 | 6,25 | 343,5 | 0,1 | 87,7 | 32,2 | 31,0 | 78,8 |
| 22 | P | 425,3 | I | 31,8 | c | 0,5 | 240 | 2 | 400,8 | 0,2 | 95,2 | 42,5 | 42,4 | 81,0 |
| 23 | M | 403,0 | I | 24,9 | a | 1,6 | 240 | 10,75 | 311,6 | 0,3 | 83,1 | 28,5 | — | 75,8 |
| 24 | N | 485,5 | I | 21,7 | a | 0,5 | 240 | 4,25 | 425,8 | <0,1 | 90,0 | 34,9 | 34,9 | 74,0 |
| 25 | O | 477,5 | I | 28,4 | a | 0,5 | 240 | 4,5 | 458 | 0,1 | 97,8 | 43,2 | 41,2 | 83,1 |
| 26 | R | 401,5 | I | 26,0 | c | 3,2 | 280 | 1,75 | 330 | 0,1 | 88,1 | 20,8 | — | 49,9 |
| 27 | S | 400,0 | I | 31,2 | f | 1,6 | 240 | 3,75 | 358,3 | 0,2 | 97,5 | 33,5 | 33,2 | 81,1 |
| 28 | S | 474,3 | I | 27,9 | g | 1,6 | 240 | 4,75 | 447,6 | 0,1 | 96,6 | 38,9 | 38,8 | 80,0 |
| 29 | S | 406,6 | I | 27,6 | h | 1,6 | 240 | 4 | 371,6 | 0,2 | 96,5 | 34,3 | 33,75 | 80,4 |

EXAMPLE 30

A metering vessel, which can be heated, for the glyceride subsequently to be fed into the reactor is installed in the apparatus described in Example 1. 500 g of technical grade tallow (saponification number 188.5, AN 0.7) are initially introduced with 27 g of 30% strength by weight sodium methylate (in methanol), and gaseous methanol is passed through, starting at 225° C. The temperature is then increased up to 240° C., and glycerol and tallow fat acid methyl ester are discharged. During this, tallow is subsequently metered in such that the same amount of reaction mixture is always present in the reactor. At a constant temperature of 240° C. and with uniform metering in of methanol gas and fat and continuous discharge of the reaction products, the reaction is interrupted after 14.5 hours. A total of 2,008 g of tallow (including the initial amount of 500 g) and 6,350 g of methanol (corresponding to 27.4 moles of methanol per 1,000 g of stationary glyceride phase per hour) has been passed through. The condensation vessels are emptied into a settling vessel after every 3 hours. In the settling vessel, the crude condensate is worked up as in Example 1. 1,980.3 g of dried tallow fat acid methyl ester (AN 0.4; 98.0% of theory, corrected with the acid number) and 162.1 g of crude glycerol are obtained in this manner. According to periodate determination, this corresponds to 148.6 g of glycerol (72.2% of theory).

The following further experiments have been carried out by the continuous reaction procedure described above. The reaction parameters and results are shown in Table II.

TABLE 2

| Example | Glyceride Type | Glyceride Amount (g)* | Alcohol Type | Alcohol Throughput** | Catalyst Type | Catalyst % by weight based on the glyceride | Temp. (°C.) | Reaction time (h) | Ester Amount (g) | Ester AN | product % of theory | Crude glycerol (g) | Glycerol by the periodic method (g) | % of glycerol of theory |
|---|---|---|---|---|---|---|---|---|---|---|---|---|---|---|
| 30 | A | 1476,4 | I | 21,9 | a | 0,5 | 240 | 13,5 | 1432,9 | 0,4 | 96,4 | 137,0 | 133,0 | 83,7 |
| 31 | E | 2533,2 | I | 31,0 | c | 2,25 | 240 | 17 | 2475,7 | 0,3 | 97,4 | 212,3 | 205,9 | 79,3 |
| 32 | L | 1458,9 | I | 29,5 | c | 2,4 | 240 | 10,25 | 1357,0 | 0,5 | 96,2 | 125,5 | 120,7 | 83,8 |

We claim:

1. A process for the preparation of fatty acid esters of short-chain primary and secondary alcohols with 1 to 5 carbon atoms by transesterification of glycerides with such short-chain alcohols in the presence of transesterification catalysts at elevated temperatures, which comprises bringing the liquid glyceride into intimate contact with a stream of gaseous alcohol at temperatures of at least 210° C., the throughput of this stream per unit time being at least such that it is capable of rapidly discharging the resulting product mixture of glycerol and fatty acid ester together out of the reaction zone, after which the product mixture is condensed and subjected to phase separation into a fatty acid ester phase and a glycerol phase and the excess gaseous alcohol is recycled to the reaction zone.

2. The process as claimed in claim 1, wherein the throughput of gaseous alcohol is at least 8 moles/kg of glyceride per hour.

3. The process as claimed in claim 1, wherein up to 30% of an inert gas are also added to the amount of alcohol passed through.

4. The process as claimed in claim 1, wherein the alcohol is ethanol, propanol, isopropanol or methanol.

5. The process as claimed in claim 1, wherein the alcohol is methanol.

6. The process as claimed in claim 1, wherein glyceride is initially introduced into the reactor and the initially introduced amount of glyceride is largely maintained by feeding glyceride in at the rate at which it is consumed during the reaction.

7. The process as claimed in claim 1, wherein the transesterification of the glyceride is carried out under a pressure not exceeding about 5 bar.

8. A process for the preparation of fatty acid esters of short-chain primary and secondary alcohols with 1 to 5 carbon atoms by transesterification of glycerides with such short-chain alcohols in the presence of transesterification catalyst at elevated temperatures, which comprises bringing the liquid glyceride into intimate contact with a stream of gaseous alcohol at temperatures of at least 210° C. in a reaction zone, the throughput of this stream per unit time being at least such that it is capable of rapidly discharging the resulting product mixture consisting essentially of glycerol and fatty acid ester together out of the reaction zone, passing the stream of gaseous alcohol out of the reaction zone with the said product mixture contained therewithin, and subsequently condensing the product mixture and subjecting the product mixture to phase separation into a fatty acid ester phase and a glyercol phase in a separation zone outside of said reaction zone, and recycling the excess gaseous alcohol to the reaction zone.

9. A process as claimed in claim 8, wherein the throughput of gaseous alcohol is at least 8 moles/kg of glyceride per hour.

* * * * *